United States Patent [19]

Harrison

[11] 4,310,379

[45] Jan. 12, 1982

[54] REINFORCER APPLICATOR

[76] Inventor: John P. Harrison, 261 Peyton-Conquitt, Shreveport, La. 71115

[21] Appl. No.: 93,379

[22] Filed: Nov. 13, 1979

[51] Int. Cl.[3] ..... B65C 11/00

[52] U.S. Cl. ..... 156/541; 156/584; 156/DIG. 48

[58] Field of Search ..... 156/518, 541, 542, 584, 156/DIG. 48, 261, 513, 514, 577

[56] References Cited

U.S. PATENT DOCUMENTS

| | | | |
|---|---|---|---|
| 2,228,372 | 1/1941 | Stuhlinger | 156/261 |
| 2,441,821 | 5/1948 | Kendall | 156/513 |
| 2,591,935 | 4/1952 | Heigl | 156/513 |
| 3,457,815 | 7/1969 | Cahill | 156/513 |
| 3,668,047 | 6/1972 | Heller | 156/541 |
| 4,028,170 | 6/1977 | Savarimuthu | 156/513 |

*Primary Examiner*—Michael G. Wityshyn
*Attorney, Agent, or Firm*—John M. Harrison

[57] ABSTRACT

A reinforcer applicator for applying gummed reinforcers to individual, punched sheets of paper which includes a base member, a beam pivotally carried by one end of the base member, and a ratchet-and-drum assembly in articulated cooperation with the beam to advance a tape carrying a plurality of gummed reinforcers from a supply drum through the ratchet-and-drum system to effect deposition of the gummed reinforcers on the sheets of paper responsive to depression of the beam.

10 Claims, 7 Drawing Figures

REINFORCER APPLICATOR

BACKGROUND OF THE INVENTION

1. Field of the Invention

This invention relates to the reinforcement of prepunched sheets of paper for insertion in ring binders or other folder means in the accumulation of multiple sheets of paper using one or more punched apertures. More particularly, the invention relates to a device for mechanically depositing individual gummed reinforcers from a continuous tape on the prepunched sheets of paper. The reinforcer applicator of this invention is designed to receive each individual aperture in the prepunched sheets and to semi-automatically apply a "donut" shaped gummed reinforcer to the area of the paper surrounding the aperture responsive to manipulation of the device. The reinforcer applicator machine is spring-loaded, and automatically advances the individual gummed reinforcers into position for application to the paper with each manipulation. Reloading of the device is quickly and easily accomplished upon depletion of gummed reinforcers by removing the empty tape and inserting a new one according to the procedure hereinafter described.

2. Description of the Prior Art

Gummed labels for reinforcing prepunched sheets of paper have in the past been supplied individually in boxes or packages, and applied as such by moistening the gum or glue-laden side and applying the reinforcer to the paper by hand. Handling of the reinforcers is difficult, not only because of the small size of the donut-shaped device, but also due to the glue, which tends to stick to the user's hands. Application of the reinforcer to the paper is likewise difficult, since the moistened glue is even more sticky, and alignment of the reinforcer aperture with the hole in the paper is not easy. A more recent innovation includes positioning the preglued reinforcers on strips or rolls of waxed paper or tape for easier removal and application. However, this improvement does not solve the problem of alignment of the reinforcer aperture with the hole in the paper, and the reinforcer still adheres to the fingers during application.

Accordingly, it is an object of this invention to provide a new and improved mechanical device for applying gummed reinforcers to prepunched sheets of paper which automatically removes the individual reinforcers from a tape, aligns the hole in the reinforcer with the respective aperture in the paper, and deposits the reinforcer on the paper, all responsive to hand manipulaton of the device.

Another object of this invention is to provide a new and improved reinforcer applicator which is characterized by a single, pivotally-mounted beam and a drum-and-ratchet system or assembly which cooperate to selectively advance a tape carrying multiple donut-shaped, gummed reinforcers from a supply drum to a reinforcer deposition area where the gummed reinforcers are individually deposited on prepunched sheets of paper, with the reinforcer aperture in alignment with the holes in the paper.

Yet another object of this invention is to provide a device for semi-automatic application of gummed reinforcers on prepunched sheets of paper without the necessity of handling the individual reinforcers.

SUMMARY OF THE INVENTION

These and other objects of the invention are provided in a reinforcer applicator which includes a base, a beam pivotally mounted on one end of the base, and a ratchet-and-drum assembly provided at the opposite end of the base and operable to advance a tape carrying a plurality of gummed reinforcers from a supply drum to the forward end of the base for sequential deposition of the gummed reinforcers or prepunched paper sheets, responsive to manipulation of the beam.

BRIEF DESCRIPTION OF THE DRAWING

The reinforcer applicator of this invention will be better understood by reference to the accompanying drawing, wherein.

DESCRIPTION OF THE PREFERRED EMBODIMENTS

Figure 1:
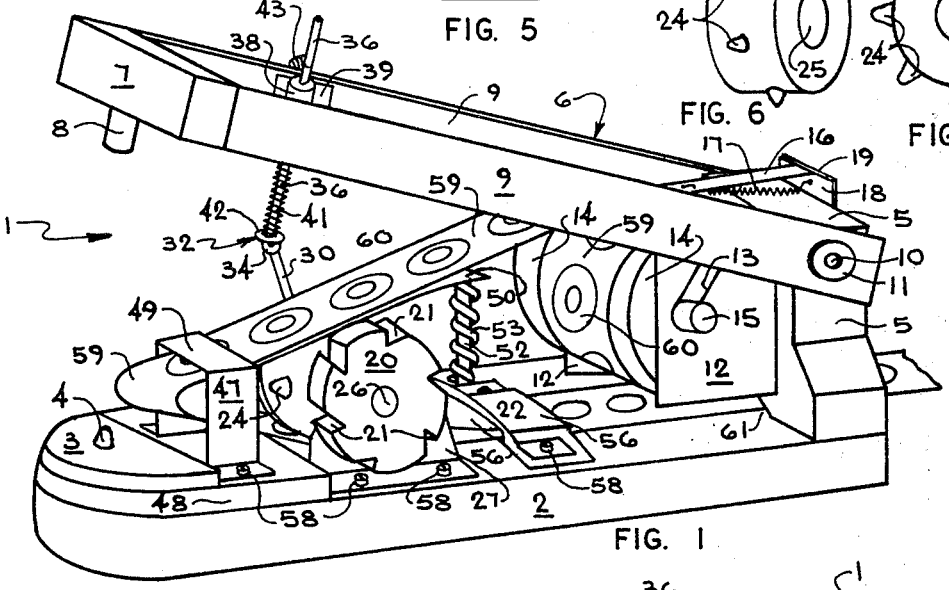
FIG. 1 is a perspective view of the reinforcer applicator in open configuration and loaded with a reinforcer tape.
Figure 3:
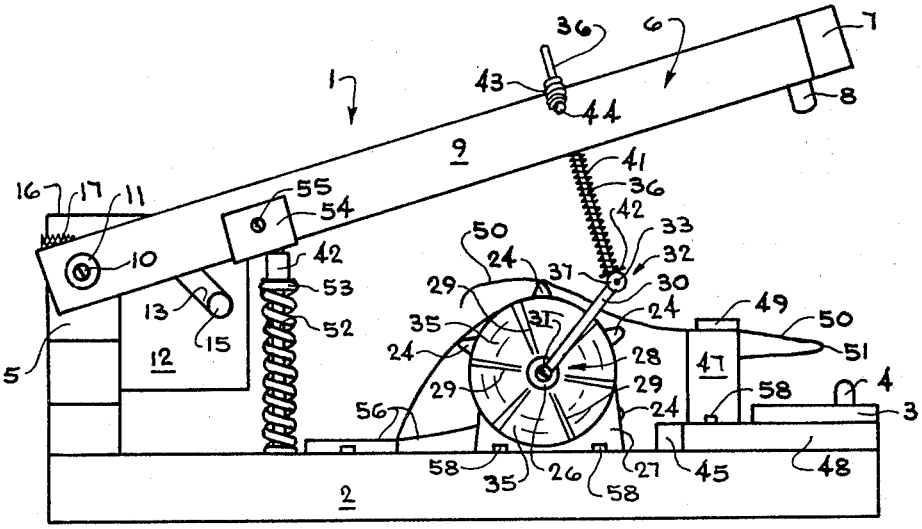
FIG. 3 is a right side elevation of the applicator illustrated in FIG. 2.

Referring now to FIGS. 1 and 3 of the drawing, the reinforcer applicator of this invention is generally illustrated by reference numeral 1, and includes a base 2, with an elevated guide peg mount 3 at the forward end and an upward standing rear support 5, at the opposite end of base 2. A beam, generally illustrated by reference numeral 6, includes a pair of beam arms 9, pivotally mounted on rear support 5 by means of beam pins 10 and washers 11. Beam 6 is generally rectangular in shape, with generally parallel beam arms 9 extending from pivotal attachment at one end on rear support 5, to spaced attachment to a press mount 7, located at the opposite end. A downwardly extending, hollow press 8 is mounted on press mount 7, and is located for axial alignment with an upwardly projecting guide peg 4, mounted on guide peg mount 3 when beam 6 is depressed. Guide peg 4 is formed of a smaller diameter than the hollow interior of press 8, in order to facilitate registration of guide peg 4 inside press 8 when beam 6 is depressed, as hereinafter described. A beam return pin 52 and cooperating beam return spring 53 are slidably attached to a return pin bracket 54, mounted on one of beam arms 9 by means of bracket screw 55, with beam return spring 53 biased between a spring retainer 42, slidably fitted on beam return pin 52, and the base 2. Beam return 52 is in turn slidably positioned in return pin bracket 54.

Figure 5:
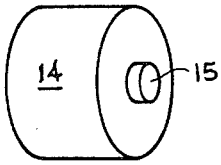
FIG. 5 is a perspective view of the tape supply drum of the reinforcer applicator illustrated in FIGS. 1–3.
Figure 6:
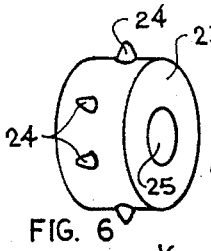
FIG. 6 is a perspective view of the drive drum of the reinforcer applicator.
Figure 7:
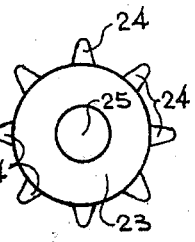
FIG. 7 is a side elevation of the drive drum illustrated in FIG. 6.

Referring now specifically to FIGS. 1, 6 and 7, a pair of drive drum mounts 27 are secured to base 2 at a point behind guide peg mount 3 and tape guide mount 48, by means of mount screws 58. A drive drum axle 26 is rotatably mounted in drive drum mounts 27, and carries a drive drum 23, in fixed relationship by tight registration with a drum axle aperture 25, provided in drive drum 23. A plurality of drive teeth 24 project from the face of drive drum 23, as illustrated in FIGS. 6 and 7. A ratchet wheel 20, with multiple ratchet stops 21, is mounted in fixed relationship on one end of drive drum axle 26, and a cooperating pawl 22, having one end adapted for engagement with the ratchet stops 21 of ratchet wheel 20, is mounted to base 2 by one of mount screws 58.

Figure 2:
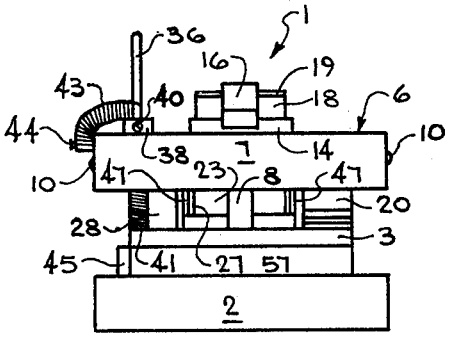
FIG. 2 is a front elevation of the reinforcer applicator illustrated in FIG. 1 in closed configuration with the tape removed.

Referring now to FIGS. 2 and 3, spacing wheel 28, more particularly illustrated in FIG. 3 of the drawing, is mounted in fixed relationship on drive drum axle 26. Spacing wheel 28 is provided with a plurality of shoulders 29 and bevelled faces 35 connecting shoulders 29, formed in the surface of spacing wheel 28. A connecting arm 30 is mounted in pivotal relationship on drive drum axle 26 by means of a connecting arm bolt 31, which is inserted through an aperture in connecting arm 30. A push rod 36 is pivotally attached to a connecting arm knuckle 34 of connecting arm 30, by means of a push rod knuckle 37 and a cooperating pin 33, to form articulated joint 32. The opposite end of push rod 36 is attached to one of beam arms 9 by means of push rod mount 38 and push rod bracket 39, more particularly illustrated in FIGS. 1 and 2. A push rod spring 41 is positioned on push rod 36, and is biased in position between a spring retainer 42 and push rod mount 38. A set screw 40 serves to adjustably position push rod 36 in push rod mount 38 and permits adjustment of the tension in push rod spring 41. A beam spring 43 is mounted on one of beam arms 9, with one end secured to the beam arm by means of beam spring pin 44 and the opposite end fixed to push rod 36. The bias of beam spring 43 causes connecting arm 30 to traverse bevelled faces 35 and engage shoulders 29, as hereinafter described. Accordingly, depression of beam 6 forces push rod 36 and connecting arm 30 downwardly, and spacing wheel 28 turns in the clockwise direction, through the action of articulated joint 32, as further hereinafter described.

Referring again to FIGS. 1, 2, 3, and 5 of the drawing, a tape supply drum 14 is removably mounted in the rear of reinforcer applicator 1, with a supply drum axle 15 rotatably fitting in mount slots 13, provided in drum mounts 12. A drum bias 16 is pivotally mounted on a drum bias hinge 19, mounted on a drum bias plate 18, which is in turn attached to rear support 5. A drum bias spring 17 is attached to, and positioned between drum bias plate 18 and drum bias 16 to apply pressure on drum bias 16 against the face of tape supply drum 14.

As further illustrated in FIG. 1 of the drawing, a length of reinforcer tape 59 is wound on tape supply drum 14 and carries a supply of gummed reinforcers 60, placed in spaced relationship throughout the length of reinforcer tape 59. One end of reinforcer tape 59 is unwound from tape supply drum 14, passed over upper tape guide 50, and is then threaded between guide cap 49 and upper tape guide 50, and around tape guide tip 51. The end of reinforcer tape 59 is then threaded through tape guide frame 47, which consists of a pair of vertically oriented legs carrying guide cap 49 and upper tape guide 50. The tape is next wound over tape tensioner 57, illustrated in FIG. 2, drive drum 23, where the apertures in the leading reinforcers are placed in registration with the drive teeth 24 projecting from drive drum 23, to permit winding of the tape on drive drum 23 by normal operation of reinforcer applicator 1. The excess reinforcer tape 59 remaining after reinforcers 60 have been deposited is routed through lower tape guide 56 and finally, through rear support slot 61 in rear support 5, and may be removed, as desired.

Figure 4:
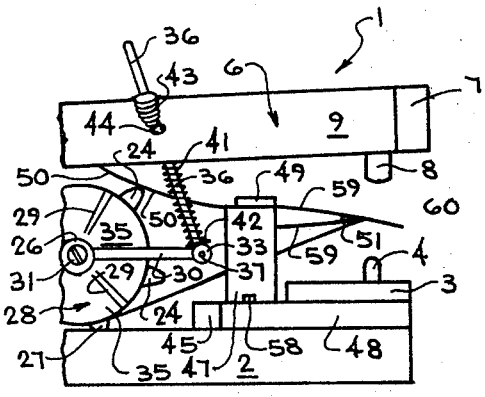
FIG. 4 is a right side elevation, partially in section, of the reinforcer application illustrated in FIG. 1 in partially closed configuration.

In operation, referring again to FIGS. 1–4 of the drawing, a prepunched sheet of paper to be reinforced (not illustrated) is positioned with one of the prepunched apertures fitted over guide peg 4 and that area of the paper sheet surrounding the hole and guide peg 4, lying flat against guide peg mount 3. Downward pressure is then applied to beam 6, and as this member begins its descent, push rod 36 forces connecting arm 30 downwardly and into registration with one of shoulders 29 in spacing wheel 28. The continued downward travel of beam 6 forces connecting arm 30 further downwardly, and causes spacing wheel 28, drive drum 23, ratchet wheel 20 and drive drum axle 26 to rotate in the clockwise direction as viewed in FIG. 3. This movement of connecting arm 30 and spacing wheel 28 is facilitated by articulated joint 32 connecting arm 30 and push rod 36. The initial rotation of spacing wheel 28 causes connecting arm 30 to rotate into contact with one of shoulders 29, and this engagement causes spacing wheel 28, drive drum 23, and ratchet wheel 20, which are fixedly attached to drive drum axle 26, to rotate in the clockwise direction. Rotation of drive drum 23 causes reinforcer tape 59 to unwind from tape supply drum 14 and slide over upper tape guide 50, around tape guide 51 and through tape guide frame 47 as it traverses tape guide 46. The abrupt turn of reinforcer tape 59 around tape guide tip 51 causes the leading one of reinforcers 60 riding on reinforcer tape 51 to detach from the tape and project downwardly above guide peg 4 as the tape continues its forward progress, as illustrated in FIG. 4. Further depression of beam 6 causes additional compression of beam return spring 53 and downward movement of push rod 36 and connecting arm 30 until articulated joint 32 contacts connecting arm stop 45. Beam 6 continues to pivot downwardly against the bias of beam return spring 53 and push rod spring 41 responsive to constant pressure until press 8 contacts the leading one of reinforcers 60, projecting outwardly from reinforcer tape 59 and over guide peg 4, as illustrated in FIG. 4, and effects registration between the aperture in the reinforcer and guide peg 4, as illustrated in FIG. 2. As press 8 closes over guide peg 4, it presses the released one of the reinforcers 60 onto the paper surrounding guide peg 4, thus reinforcing the prepunched paper.

Release of pressure from beam 6 permits the beam to move upwardly due to the bias of push rod spring 41 and beam return spring 53, with press 8 disengaging guide peg 4 and beam 6 returning to the position illustrated in FIGS. 1 and 3. Spacing wheel 28 maintains its position as connecting arm 30 traverses bevelled face 35 of spacing wheel 28, and locks into the next succeeding one of shoulders 29 when beam 6 returns to its original upright position.

Spacing wheel 28 and drive drum 23 are rotating in the counter clockwise direction responsive to downward movement of beam 6 and, ratchet wheel 20 is also rotating in the counter-clockwise direction as viewed in FIG. 1, with pawl 22 traversing the face of ratchet wheel 20. When articulated joint 32 contacts connecting arm stop 45, pawl 22 engages one of ratchet stops 21, and this action of ratchet wheel 20 and pawl 22 insures a constant positive linear advancement of reinforcer tape 59 in one direction for each manipulation of beam 6. Accordingly, the reinforcer applicator 1 is synchronized to insure the appearance of each one of reinforcers 60 at guide peg 4 for each complete manipulation of beam 6.

It will be appreciated by those skilled in the art that the reinforcer applicator of this invention is easily loaded and maintained, since tape supply drum 14 is removably positioned in drum mounts 12 with supply drum axle 15 fitted in mount slots 13. Accordingly, supply drum 14 can be removed from drum mounts 12 and a fresh supply of reinforcer tape 59 wound on the drum, as necessary.

Having described my invention with the particularity set forth above, what is claimed is:

1. A reinforcer applicator comprising:

(a) a base member having an upwardly projecting guide peg;

(b) a beam having a pair of arms in spaced, parallel relationship to each other, with one end of each of said arms pivotally mounted to said base member;

(c) hollow press means projecting downwardly from the free end of said beam and in arcuate alignment with said guide peg;

(d) a tape supply drum rotatably mounted on said base member to receive a tape carrying a supply of gummed reinforcers in spaced relationship and having perforations extending through said tape; and (e) drum and ratchet means cooperating with said beam and said tape to advance said tape and sequentially deposit said gummed reinforcers in registration with said guide peg responsive to depression of said beam.

2. The reinforcer applicator of claim 1 wherein said drum and ratchet means further comprises:

(a) a drive drum axle rotatably mounted on said base member;

(b) a ratchet wheel fitted with a plurality of ratchet stops fixedly mounted on one end of said drive drum axle, and a pawl having one end secured to said base member and the opposite end cooperating with said ratchet stops to permit rotation of said ratchet wheel in one direction only;

(c) a drive drum fixedly mounted on said drive drum axle adjacent to said ratchet wheel and having teeth for engagement with said perforations in said tape;

(d) a spacing wheel fixedly mounted on said drive drum axle and provided with a plurality of spaced bevelled faces and cooperating shoulders; and (e) articulated arm means having one end pivotally carried by said drive drum axle and in contact with said bevelled faces and shoulders, and the opposite end pivotally attached to said beam, for rotating said spacing wheel, said ratchet wheel, and said drive drum, and advancing said tape upon depression of said beam.

3. The reinforcer applicator of claim 1 further comprising upper tape guide means mounted on said base member above and rearwardly of said guide peg for guiding said tape from said tape supply drum to said drive drum and facilitating sequential release of said gummed reinforcers from said tape above said guide peg upon activation of said drum and ratchet means.

4. The reinforcer applicator of claim 1 further comprising a beam return spring in cooperation with said beam for periodically returning said beam to a selected initial configuration of said beam upon release of downwardly applied pressure from said beam.

5. The reinforcing applicator of claim 1 wherein said drum and ratchet means further comprises:

(a) a drive drum axle rotatably mounted on said base member;

(b) a ratchet wheel fitted with a plurality of ratchet stops fixedly mounted on one end of said drive drum axle, and a pawl having one end secured to said base member and the opposite end cooperating with said ratchet stops to permit rotation of said ratchet wheel in one direction only;

(c) a drive drum fixedly mounted on said drive drum axle adjacent to said ratchet wheel and having teeth for engagement with said perforations in said tape;

(d) a spacing wheel fixedly mounted on said drive drum axle and provided with a plurality of spaced bevelled faces and cooperating shoulders;

(e) articulated arm means having one end pivotally carried by said drive drum axle and in contact with said bevelled faces and shoulders, and the opposite end pivotally attached to said beam, for rotating said spacing wheel, said ratchet wheel, and said drive drum, and advancing said tape upon depression of said beam; and further comprising upper tape guide means mounted on said base member near said guide peg for guiding said tape from said tape supply drum to said drive drum and facilitating sequential release of said gummed reinforcers from said tape above said guide peg upon activation of said drum and ratchet means; and a beam return spring in cooperation with said beam for periodically returning said beam to the initial configuration upon release of pressure from said beam.

6. The reinforcer applicator of claim 2 wherein said articulated arm means further comprises:

(a) a connecting arm having one end pivotally attached to said drive drum axle and the opposite end shaped to form a connecting arm knuckle, said connecting arm contacting said shoulders and said bevelled faces of said spacing wheel;

(b) a push rod having a push rod knuckle at one end in pivotal cooperation with said connecting arm knuckle and slidably mounted on said beam;

(c) a push rod spring mounted on said push rod between said push rod knuckle and said beam; and (d) a beam spring carried by said beam and attached to said push rod to bias said push rod inwardly of said beam and said connecting arm against said bevelled faces and said shoulders.

7. The reinforcer applicator of claim 1 further comprising drum bias means carried by said base member and contacting said tape to hold said tape against said tape supply drum.

8. The reinforcer applicator of claim 1 further comprising:

(a) upper tape guide means mounted on said base member above and rearwardly of said guide peg for guiding said tape from said tape supply drum to said drive drum and facilitating sequential release of said gummed reinforcers from said tape above said guide peg upon activation of said drum and ratchet means; p1 (b) a beam return spring in cooperation with said beam for periodically returning said beam to a selected initial configuration of said beam upon release of downwardly applied pressure from said beam; and (c) drum bias means carried by said base member and contacting said tape to hold said tape against said tape supply drum.

9. The reinforcing applicator of claim 1 wherein said drum and ratchet means further comprises:

(a) a drive drum axle rotatably mounted on said base member;

(b) a ratchet wheel fitted with a plurality of ratchet stops fixedly mounted on one end of said drive drum axle, and a pawl having one end secured to said base member and the opposite end cooperating with said ratchet stops to permit rotation of said ratchet wheel in one direction only;

(c) a drive drum fixedly mounted on said drive drum axle adjacent to said ratchet wheel and having teeth for engagement with said perforations in said tape;

(d) a spacing wheel fixedly mounted on said drive drum axle and provided with a plurality of spaced bevelled faces and cooperating shoulders;

(e) articulated arm means having one end pivotally carried by said drive drum axle and in contact with said bevelled faces and shoulders, and the opposite end pivotally attached to said beam, for rotating said spacing wheel, said ratchet wheel, and said drive drum, and advancing said tape upon depression of said beam; and further comprising upper tape guide means mounted on said base member near said guide peg for guiding said tape from said tape supply drum to said drive drum and facilitating sequential release of said gummed reinforcers from said tape above said guide peg upon activation of said drum and ratchet means; a beam return spring in cooperation with said beam for periodically returning said beam to the initial configuration upon release of pressure from said beam; and drum bias means carried by said base member and contacting said tape to hold said tape against said tape supply drum.

10. The reinforcer applicator of claim 9 further comprising a lower tape guide carried by said base member for channelling said tape to the rear of said base member after said reinforcers have been removed from said tape.

* * * * *